US008236384B2

(12) United States Patent
Azuelos et al.

(10) Patent No.: US 8,236,384 B2
(45) Date of Patent: Aug. 7, 2012

(54) METHODS FOR ENHANCING VISUAL ASPECT STABILITY

(75) Inventors: Olivier Azuelos, Quebec (CA); Michele Pagliarulo, Quebec (CA); Steve Pellerin, Quebec (CA); Marcel Goyer, Quebec (CA)

(73) Assignee: C&D Zodiac, Inc., Huntington Beach, CA (US)

( * ) Notice: Subject to any disclaimer, the term of this patent is extended or adjusted under 35 U.S.C. 154(b) by 425 days.

(21) Appl. No.: 12/541,790

(22) Filed: Aug. 14, 2009

(65) Prior Publication Data

US 2011/0039110 A1 Feb. 17, 2011

(51) Int. Cl.
*B05D 5/00* (2006.01)

(52) U.S. Cl. ..... 427/393; 427/397; 427/408

(58) Field of Classification Search ..... None
See application file for complete search history.

(56) References Cited

U.S. PATENT DOCUMENTS

2007/0151666 A1* 7/2007 Moeller et al. ..... 156/327

* cited by examiner

*Primary Examiner* — Erma Cameron

(74) *Attorney, Agent, or Firm* — Jeffer Mangels Butler & Mitchell LLP

(57) ABSTRACT

A method of enhancing visual aspect stability in wooden substrates comprised of the steps of preparing a sealing composition by mixing thermosetting resins and hardener, applying said sealing composition onto the surface of a wooden substrate; and curing said polymer. The method may additionally comprise further steps of: scuffing or sanding the cured sealing layer, applying one or more topcoat composition, and curing said topcoat composition. Interior that comprises sealed wooden substrates with enhanced visual aspect stability produced by methods of the invention are also provided.

37 Claims, No Drawings

METHODS FOR ENHANCING VISUAL ASPECT STABILITY

TECHNICAL FIELD OF THE INVENTION

The present invention relates to methods of coating wooden substrates to enhance visual aspect stability. More particularly, the sealed wooden substrate of the present invention meets the high property profile standard of materials used in the interior of aircrafts.

BACKGROUND OF THE INVENTION

Wooden materials are used for floorings and cabinets in business class and customized aircrafts. These wood materials are often coated to achieve a highly glossy, luxurious appearance. The best known method of achieving a high gloss appearance is to apply a polyurethane sealer coat to the wood substrate followed by 3 to 4 coats of polyester topcoat.

Wooden materials used for aircraft interiors must meet demanding property profiles with specifications issued by aircraft manufacturers and regulatory authorities. Particularly, the required property profile includes the visual aspect stability of the wooden substrate. Visual aspect stability is the ability of a substance or part to resist shrinkage and/or expansion. When subjected to varying degrees of temperature, moisture, pressure, or other stress, wood products coated by conventional methods do not sustain the resistance of shrinkage and/or expansion and require laborious and costly rework within as few as two months of use.

Low visual aspect stability is caused by wood cells absorbing or releasing moisture, affecting the surface finishes of the wood products. Low visual aspect stability is particularly common in wood veneers. Veneers are typically three layers of 1 to 3 millimeter of thick wood attached together, with the front layer being the decorative face. Veneers can provide the appearance of a solid wood product while greatly reducing the weight. Visual aspect stability decreases when the veneered product shrinks or expands due to external humidity or temperature changes, or more slowly under a constant humidity and temperature over a period, especially when the veneer surface layer has no underlying layers or core.

Some of the causes of the decrease of the visual aspect stability are mentioned in C. L. Forbes, Understanding and Minimizing Veneer Checking on Furniture Panels (1997), available at http://www.ces.ncsu.edu/nreos/wood/wpn/venchk.htm. Conventional measures of coating, however, do not enhance the wooden article's visual aspect stability. The present inventors have found that coating the wooden surface with conventional polymers while provides the surface with a glossy appearance, does not provide visual aspect stability even under regular weather conditions for as few as two months.

Therefore, there is a demand for improved methods in providing resistant wood or veneer finish with superior visual aspect stability to protect wooden substrates against variable temperature conditions anticipated by standard aviation complications.

BRIEF SUMMARY OF THE INVENTION

The present invention meets the aforementioned needs and avoids the problems associated with conventional coating methods. The present inventors discovered that using methods of the present invention produce wooden substrates that exhibit exceptional visual aspect stability and meet the demanding property profile of the aviation industry. Particularly, methods of the present invention produce wooden substrates that exhibit visual aspect stability for a longer time than wooden substrates treated with conventional methods.

Methods of the present invention also have the advantage of less curing time, less conditioning, and no requirement for shocking, which is the abrupt exposure of wooden substrates to extreme temperature and humidity.

In satisfaction of the foregoing advantages, the present invention provides a method for coating and sealing a wooden substrate comprising the steps of applying onto at least one surface of the wooden substrate at least one layer of sealing composition, prepared by mixing thermosetting resins with hardener; the thermosetting resin comprising, in percentage of weight, more than 50% Bisphenol A Epoxy Resin, between 0.1% and 50% Tricresyl Phosphate, and between 0.1% and 30% Glycidyl Ether, the hardener comprising, in percentage of weight, between 40% and 90% isophoronediamine, and between 5% and 30% 1,3-benzenedimethanamine; and curing the sealing composition.

The method further comprises additional steps of sanding the surface of the coated wooden substrate; applying onto the coated wooden substrate at least one layer of topcoat composition; and curing the topcoat composition. The resulting surface of the wooden substrate exhibits enhanced visual aspect stability.

The present invention also provides sealed wooden substrate produced by methods of the present invention. The sealed wooden substrate can be used for interior for airplane, watercraft and automobile.

DETAILED DESCRIPTION OF THE INVENTION

The first aspect of the present invention provides a method for sealing a wooden substrate comprising the following steps:

a. preparing a sealing composition by mixing a thermosetting resin with a hardener; the thermosetting resin comprising, in percentage of weight, more than 50% Bisphenol A Epoxy Resin, between 0.1% and 50% Tricresyl Phosphate, and between 0.1% and 30% Glycidyl Ether; the hardener comprising, in percentage of weight, between 40% and 90% isophoronediamine, and between 5% and 30% 1,3-benzenedimethanamine;

b. applying onto at least one surface of the wooden substrate at least one layer of sealing composition; and c. curing the sealing composition;

wherein the sealed wooden substrate exhibits enhanced visual aspect stability.

The thermosetting resin comprises, in percentage of weight, more than 50%, preferably more than 60%, and most preferably more than 70% Bisphenol A Epoxy Resin; between 0.1% and 50%, preferably between 10% and 40%, and most preferably between 20% 30% Tricresyl Phosphate; between 0.1% and 30%, preferably between 0.1% and 20%, and most preferably between 0.1% and 10% Glycidyl Ether.

The hardener comprises, in percentage of weight, between 40% and 90%, more preferably between 50% and 80%, and most preferably between 60 and 70% isophoronediamine; between 5% and 50%, more preferably between 10% and 40%, and most preferably between 20% and 30% 1,3-benzenedimethanamine.

The mixture of the thermosetting resin and hardener creates epoxy, or polyepoxide, which is a polymer formed by the polymerization of two chemicals: epoxide "resin" and polyamine "hardener" (catalyst). When the two compounds are mixed together, the amine groups of the hardener react with the epoxide groups of the resin to form a covalent bond.

The polymerization results in the polymer being heavily cross-linked, thus creating a rigid and strong coating.

Preferably, the sealing composition comprises Techno Lam 8481. "Techno Lam 8481" herein refers to the epoxy formed by mixing the epoxide resin and hardener available from Polymeres Technologies, in Saint-Hyacinth, Canada, under the product name "Techno Lam 8481." Part A (Resin) of Techno Lam 8481 comprises, in percentage of weight, more than 70% Bisphenol A Epoxy Resin, between 0.1% and 30% Tricresyl Phosphate, and between 0.1% and 10% Glycidyl Ether; Part B (Hardener) of Techno Lam 8481 comprises, in percentage of weight, between 60% and 70% of Isophoronediamine, and between 20% and 30% of 1,3-benzenedimethanamine.

In the alternative, the sealing composition comprises Techno Coat 8482 EXP. "Techno Coat 8482 EXP" herein refers to the epoxy formed by mixing the epoxide resin and hardener available from Polymeres Technologies, in Saint-Hyacinthe, Canada, under the product name "Techno Coat 8482 EXP." Techno Coat 8482 EXP comprises the same epoxide resin and hardener as Techno Lam 8481 except that Techno Lam 8481 additionally comprises fire retardants, whereas Techno Coat 8482 EXP does not.

Before the sealing composition is applied, the wooden substrate may be cleaned of contamination and debris then prepared for the application using methods that are familiar to those skilled in the art. The cleaning may be accomplished by mechanical means (i.e. sand blasting, wire brush, etc.), chemical means (acid wash, etc.), or any other known technique for cleaning. Preferably the wooden substrate is cleaned with a degreaser and sanded before the sealing composition is applied. Care must be taken when applying the sealing composition comprising Techno Lam 8481 or Techno Coat 8482 EXP. Degreasers like acetone must fully evaporate before Techno Lam 8481 or Techno Coat 8482 EXP is applied to the wooden substrate as it may cause a volatile reaction if remnants of the degreasers exist.

The wooden substrate may be pre-treated with fire retardant. The flame retardant to be used is selected from known flame retardants derived from phosphoric acids, such as ammonium and guanidine phosphates, mixtures of polyphosphoric acids and ammonia, and dicyandiamide. Other fire retardants known in the art may also be used to pre-treat the wooden substrate.

The wooden substrate may be stained or colored before the sealing composition is applied. The method of staining or coloring and the choice of stain are not particularly limited as long as it is typically used for this purpose. For example, the stain may be solvent-based or water-based, dye-based or pigment-based, grain-rising or non-grain-rising, etc., depending on the wood species and the color needed. As discussed above, care must be taken when applying sealing composition onto wooden substrates stained with solvent-based stain, as Techno Lam 8481 and Techno Coat 8482 EXP may cause the stain to run.

According to the present invention, the sealing composition may be applied to a wooden substrate already coated with other polymer compositions. The polymer composition used to pre-coat the wooden substrate is not particularly limited as long as it is typically used for this purpose. Such polymer compositions can include epoxy, urethane, polyurethane, acrylic, MMA, polyester and the like. For example, wooden substrate stained with solvent-based paint may be coated with a water-based polymer composition before the sealing composition is applied to prevent the stain from "running," i.e. stain pigments coming loose from the surface, when they come in contact with Techno Lam 8481 or Techno Coat 8482 EXP.

The wooden substrate of the present invention may be solid wood or wood veneer. A wood veneer has at least one surface comprised of relatively thin and typically higher cost wood layer overlying a layer or layers of relatively thick and typically lower cost material or materials comprised of wood, wood fibers or other cellulosic or metallic substances.

The wooden substrate may be made of woods selected from the group comprised of, but not limited to, alder, ash, aspen, bamboo wood, beech, birch, bocote, bubinga, butternut, cedar, cherry, cocobolo, canarywood, cypress, ebony, fir, hickory, holly, kingwood, lacewood, locust, mahogany, maple, oak, usage, parawood, padauk, pecan, persimmon, poplar, pine, purpleheart, redheart, redwood, rosewood, Spanish cedar, sycamore, teak, tulipwood, walnut, wenge, zebrawood, and ziricote.

The sealed wooden substrate have a wide variety of uses, including furniture, kitchen cabinets, and floorings. Preferably, the sealed wooden substrate is used for surface of cabinets. Most preferably, the sealed wooden substrate is used for surface of cabinets for interiors of aircraft, watercraft, or automobiles. It should be understood that the wooden substrate may be attached to the surface of the cabinet, which itself may be made of composites, plastics, woods or the like.

According to the present invention, the sealing composition may include one or more agents to provide other improved properties. The agents are not particularly limited. Exemplary agents include antistatic agents, biostabilizers, tittering agents, chemical blowing agents, conductivity agents, corrosion inhibitors, drying agents, flame retardants, fluorescent whiting agents, hollow and/or solid glass spheres, lubricants, pigments, plasticizers, scent additives, UV stabilizers, viscosity adjustment fillers, fungicides, etc. For example, flame retardants may be added into the sealing composition to enhance resistance to flammability. Pigments may be added into the sealing composition to color the sealing composition. Changing the color of the coating is known in the art as "shading"; whereas changing the color of the wooden substrate itself is known as "staining."

The sealing composition is applied in an amount sufficient to provide good wet coat coverage and a continuous coating on the wooden substrate. The thickness of the sealing composition can be freely set depending on the various functions necessary for the surface of the wooden substrate, and is not particularly limited as long as it enhances the visual aspect stability of the wooden substrate. Preferably, the sealing composition is applied at ambient temperature and pressure, to at least one surface of the wooden substrate to a wet thickness of about 1 to 10 mils and, preferably, to a wet thickness of about 4 to 8 mils. One mil is one thousandth of an inch.

The sealing composition is applied onto the wooden substrate by any suitable method known to those skilled in the art to which the present invention pertains. Ordinarily, methods of application include, but are not limited to, brushing, spraying, immersion, dipping, painting, pouring on, wiping, roll coating (reverse fill, direct roll, etc.), and curtain coating.

Preferably the sealing composition is applied onto the wooden substrate by spraying. More preferably, two cross-coats, which is one sprayed vertically and one sprayed horizontally, of 3 to 4 mils of sealing composition are applied onto the wooden substrate by spraying.

Once the sealing composition has been applied onto the wooden substrate, it is cured by methods known to those skilled in the art for curing epoxy polymers. Curing is a chemical reaction, which causes the liquid resins to solidify by way of a free radical or cationic polymerization reaction. Suitable curing conditions may be determined empirically based on the particular equipment and wood species employed, the surrounding atmosphere, throughput rate and ambient or elevated temperatures at the curing site.

Preferably, the sealing composition is cured by a typical drying method, such as natural drying, hot air drying, and the like. In general, a method requiring a shorter drying time and causing less degradation is preferred. Sealing composition cured by hot air drying is preferred.

For curing by hot air drying, the heating temperature is determined by the constituent components, proportion thereof and amount, and the like of the sealing composition. The heating temperature can be generally within the range of temperatures that do not cause deformation of the wooden substrate, preferably about 22° C. The method of heating is not particularly limited as long as it is typically used for hot air drying. In a typical example, a sealing composition of 3 to 4 mils wet thickness is 80% cured if it is allowed to dry at 22° C. for 24 hours, and 100% cured at 22° C. for 7 days. Heating is known to accelerate curing. More preferably, the sealing composition is cured at 22° C. for 16 hours, then heated at 40 to 50° C. for up to 16 hours. In an alternative, the seating composition is cured at 22° C. for 16 hours, and then heated at 50° C. for 3 hours.

It should be understood that 100% curing of the sealing or topcoat composition is not required to practice the present invention. A sealing or topcoat composition is substantially cured when it is acceptable to sanding or the application of the subsequent layer of compositions. For example, a first layer of sealing composition may be sanded and acceptable to the application of the second layer 15 minutes after the first sealing composition was applied as long as the first sealing layer is sufficiently solid to accept such modifications.

The sealing composition may additionally comprise a curing accelerator to facilitate the curing. The curing accelerator is not particularly limited as long as it facilitates the curing process. Preferably, the sealing composition comprises "Accelerateur 8482," which herein refers to product "Accelerateur 8482" available from Polymeres Technologies, in Saint-Hyacinthe, Canada. Preferably, Accelerateur 8482 is used to facilitate the curing of Techno Lam 8481 or Techno Coat 8482 EXP. Accelerateur 8482 comprises approximately 60% to 75% of triethanolamine, and 15 to 25% of N-aminoethylpiperazine.

After curing of the sealing composition, it may be desirable to apply subsequent layers of the same or different sealing composition to the resulting surface of the substrate. Preferably, each sealing layer is scuffed or sanded before applying the subsequent layers of sealing composition. The sealing layers additionally may be cured and scuffed in repeated fashion to provide as many layers as desired. The present inventors found that applying more than one layers of sealing composition instead of one thick layer of sealing composition produces wooden substrate with fewer microbubbles. Preferably, the first sealing layer is scuffed or sanded down to 50% of the original thickness after the sealing composition has cured. Then, another layer of sealing composition of 4 to 8 mils of wet thickness is applied, cured, scuffed or sanded, repeating the same process as the first sealing application.

It should be understood that the first layer of the sealing composition and subsequent layers thereof may be comprised of the same or different polymers. Similarly, the second and third layer of the sealing compositions may be comprised of the same or different polymers, and so on. For example, the first layer of sealing composition may be comprised of Techno Lam 8481 and the subsequent layer comprised of Techno Coat 8482 EXP.

The wooden substrate may be scuffed or sanded after the final layer of sealing composition is cured. The scuffing and sanding eliminates peaks of the sealing layers, and provides for a receptive surface for subsequent coating applications.

The method of the present invention provides protection to the underlying wooden substrate from moisture and extreme weather conditions, particularly extremes of humidity and dryness, and, thus, seals the substrate. The provided protection enhances the wooden substrate's visual aspect stability for a longer time.

A second aspect of the present invention provides a method for coating and sealing a wooden substrate comprising the following steps:

a. preparing a sealing composition by mixing a thermosetting resin with a hardener, the thermosetting resin comprising, in percentage of weight, more than 50% Bisphenol A Epoxy Resin, between 0.1% and 50% Tricresyl Phosphate, between 0.1% and 30% Glycidyl Ether, the hardener comprising, in percentage of weight, between 40% and 90% isophoronediamine, between 5% and 50% 1,3-benzenedimethanamine;
b. applying onto at least one surface of the wooden substrate at least one layer of sealing composition;
c. curing the sealing composition;
d. sanding the surface of the coated wooden substrate;
e. applying onto the coated wooden substrate at least one layer of topcoat composition; and
f. curing the topcoat composition;

wherein the coated wooden substrate exhibits enhanced visual aspect stability.

The thermosetting resin comprises, in percentage of weight, more than 50%, preferably more than 60%, and most preferably more than 70% Bisphenol A Epoxy Resin; between 0.1% and 50%, preferably between 10% and 40%, and most preferably between 20% and 30% Tricresyl Phosphate; between 0.1% and 30%, preferably between 0.1% and 20%, and most preferably between 0.1% and 10% Glycidyl Ether.

The hardener comprises, in percentage of weight, between 40% and 90%, more preferably between 50% and 80%, and most preferably between 60% and 70% isophoronediamine; between 5% and 50%, more preferably between 10% and 40%, and most preferably between 20% and 30% 1,3-benzenedimethanamine.

Preferably, the sealing composition comprises Techno Lam 8481. In the alternative, the sealing composition comprises Techno Coat 8482 EXP.

According to the method, the sealing layer is formed on the surface of the wooden substrate before the topcoat composition is applied, because the sealing layer also prevents infiltration of the topcoat into the wooden substrate and enables accurate control of the thickness after curing the sealing layer. The thickness of the sealer layer can be freely set depending on the various functions necessary for the surface of the wooden substrate, and is not particularly limited as long as the desired property of the topcoat layer can be achieved.

After curing the sealing composition, the sealing layer is scuffed or sanded to prepare application of subsequent layers of sealing composition to the resulting surface of the wooden substrate. It additionally may be cured and scuffed in repeated fashion to provide as many layers of sealing composition as desired.

The wooden substrate may be finally scuffed or sanded after the final layer of sealing composition is cured. The scuffing and sanding eliminates peaks of epoxy layers, and provides for a receptive surface for subsequent application of topcoat compositions. "At least one layer of topcoat composition" herein refers to one or more polymerizable compositions that can be successively applied to a wooden substrate and cured to form adherent layers.

The topcoat composition is not particularly limited and may be selected according to the beneficial property that it provides. The improved properties that the topcoat compositions may provide include but are not limited to: wetting and sheeting, quick drying, uniform drying, soil removal, self-cleaning, anti-spotting, anti-soil deposition, cleaner appearance, enhanced gloss, enhanced color, minor surface defect repair, smoothness, anti-hazing, modification of surface friction, release of actives, reduced damage to abrasion and transparency.

Topcoat may include, but is not limited to, these resin systems: ethylene-vinyl acetate, polypropylene, ethylene-methyl acrylate EMA and ethylene-methylmethacrylate EMAA/polyethylene copolymers, polyethylene, polyethylene acid terpolymers, polyethylene isonomers, polyamide co- and ter-polymers, thermoplastic elastomers (TPE's), acrylonitrile-butadiene-styrene, acrylonitrile halogenated polyethylene, acrylonitrile halogenated styrene, acrylic-styrene-acryonitrile, cellulose acetate, cellulose acetate-butyrate, cellulose acetate-propionate, halogenated polyethylene, halogenated polyvinyl chloride, polymonochlorotrifluoroethylene, diallyl phthalate, ethyl cellulose, ethylene-chlorotrifluoroethylene, ethylene-propylene, tetrafluoroethlyene-hexafluoropropylene-vinylidene fluoride ter-polymer, EVOH, PEBA, ethylene-tetraflurethylene, fluorinated ethylene-propylene, high-impact polystyrene, vinyl modified epoxy, liquid crystal polymer, methacrylateo-butadiene-styrene, polyamide, polyamide-imide, polyacrylonitrile, polybutylene, polybutylene terephthalate, polycarbonate, polychlorotrifluoroethylene, polyphenylene ether copolymer, polyetherether ketone, polyphenylene ether homopolymer, polyetherimide, polyethylene oxide, polyethersulphone, phenyl-formaldeahyde, perfluoroalkoxy, polyimide, polyisobutylene, polyisoethylene, paramethylstyrene, polymethylpentene, polyphenylene oxide, polyphenylene sulfide, polystyrene, polytetrafluoroethylene, polyurethane (polyester and polyether backbone), polyvinyl chloride, polyvinylidene fluoride, polyvinyl fluoride, styrene-acrylonitrile, styrene maleic anhydride, polytetra fluorethylene, urea-formaldehyde, vinyl acetate-ethylene, polyacetal, polyacrylic, polyalkyd, polyallylic esters or allyis, cellulosic esters, halogenated polyalkylene ether, cyanate/cyanamide polymers, halogenated epoxies, cycloaliphatic epoxys, epoxyimide polymers, polyester polymers, polyether polymers, and polyphenylene.

In addition, modifications to the above listed materials, including silane grafting, maleic anhydride grafting, acrylic acid grafting, and grafting of any functional group containing an active hydrogen may be used.

Preferably, the topcoat composition comprises polyester compositions, which when cured exhibits an enhanced gloss appearance. More preferably, the topcoat composition comprises Duro-Lak ZMP-7773 polyester composition, available from Duro-Lak, Inc., in Ontario, Canada.

According to the method, a topcoat is applied to the resulting surface of the wooden substrate after the sealing layer is cured. The thickness of the topcoat composition is not particularly limited as long as it is sufficient to provide the improved properties that the end user desires.

The first layer of topcoat composition and subsequent layers of topcoat composition thereof may be comprised of the same or different polymers. Similarly, the second and third layers of topcoat composition may be comprised of the same or different polymers, and so on.

The mode of curing the topcoat is not particularly limited but dependent on the particular polymer and wooden substrate used. Preferably, three cross-coats of Duro-Lak ZMP-7773 composition of wet thickness of 4 to 6 mils is applied and cured. An optional fourth cross-coat of wet thickness of 4 to 6 mils may be applied. The topcoat composition is preferably cured by drying. The preferred topcoat composition provides durability to the surface of the substrate and aids in light refraction making the surface of the substrate aesthetically pleasing.

After full cure of the first topcoat layer, the resulting surface of the substrate may be scuffed or sanded, either manually or mechanically, with an abrasive material, or using a sander to remove the uppermost peaks of the cured polymer surface. The step of sanding promotes adhesion of an additional polymer coating to the wooden substrate and enables the application of another topcoat, where such subsequent coat or coats are desired. Preferably, the topcoat composition is sanded to 50% of the thickness of the original composition after curing.

After the first topcoat layer is applied, cured, and sanded, subsequent layers of the topcoat composition may be applied to the resulting surface of the substrate, cured, then sanded, to achieve the desired thickness and effect. The resulting surface may be sanded to aid in the adhesion of a subsequent topcoat layer.

The wooden substrate may be finally polished after the final layer of topcoat composition is cured. The polishing may be achieved by sanding with increasingly higher grits of sand paper or a buffing pad. The polishing eliminates peaks of the topcoat layer and provides a smooth surface and consistent appearance.

In the alternative, if a matte finish instead of a gloss finish is desired, an additional topcoat of polymer composition suitable to create a matte finish is applied. Preferably, the additional topcoat composition comprises Duro-Lak ZMP-3000, ZMP-3001, ZMP-3002, ZMP-3003, ZMP-3005, or ZMP-3009, available from Duro-Lak, Inc., in Ontario, Canada. Sanding the topcoat layer is performed according to protocols known in the art to create a satin finish.

Finally, minor touch up may be necessary to remedy defects not treated in the sanding process. Touch up is ordinarily performed by a person checking the final wooden substrate and correcting minor unevenness, color variation, or defects by hand on a case-by-case basis. For example, the same topcoat composition of the last topcoat layer, in uncured form, may be applied by hand to fill little holes of the topcoat layer, cured, and sanded.

As applied, the sealing composition provides a seal to prevent outside moisture from changing the integrity of the wooden substrate. The resulting sealing protects the substrate from moisture and heat, and increases the visual aspect stability. The sealing composition also prevents the topcoat layer from infiltrating the wooden substrate, enhancing the performance of the topcoat layers. The resulting wooden substrate exhibits enhanced visual aspect stability as demonstrated by the wavescan test, which shows that wooden substrates sealed with methods of the present invention maintain high visual aspect stability in testing conditions for at least 337 days, compared to 110 days for wooden substrate treated with polyurethane compositions.

Topcoat compositions applied onto the coated wooden substrate provide for beneficial properties that the end user desires. For example, topcoats comprising polyester compositions applied onto wooden substrates exhibit a glossy appearance, depth of image, scratch resistance, and soil resistance suitable for luxurious setting. The glossy appearance lasts longer because the sealing layer suppresses shrinkage and/or expansion.

Another aspect of the present invention provides wooden substrates coated by coating methods described in the present invention. The coated wooden substrates of the present invention exhibit higher visual aspect stability compared to wooden substrate treated with conventional methods. Particularly, the resulting surface of the coated wooden substrate is suitable for cabinets such as those in the interior of aircraft, watercraft, and automobile.

The enhanced visual aspect stability of the wooden sample can be measured by its wavescan value. A wavescan assigns an objective value to the appearance. The appearance of a surface is determined by its "image clarity," which is sometimes referred to as "orange peel", caused by the macroscopic surface roughness patterns of the product. This imperfection reflects light in various directions and only the elements reflecting light in one direction are perceived as light areas. The BYK-Gardner wavescan is widely used in the industry to measure scattered light. The Wc value measures the surface quality using light of 1 to 3 mm wavelength. A measured signal close to 1 is an almost perfectly smooth surface. The higher the value gets, the rougher the surface.

Woods coated and polished with the regular process often have a Wc value of 4 to 5, but the Wc value of wooden substrate treated with conventional methods substantially increases within a few months. The increase of Wc value indicates the roughening of the surface of the wooden substrate. Generally, wooden substrates with Wc value more than 12 is considered aesthetically unacceptable for use in aircraft interiors. The standard is more stringent for light color woods because the roughness is more obvious.

The enhanced visual aspect stability of wooden substrates prepared by methods of the present invention is shown by the decreased change of Wc value over a long period. In one aspect of the invention, the Wc value of the wooden substrate prepared by methods of the present invention increases less than the increase of the Wc value of wooden substrate sealed with polyurethane compositions for at least 180 days starting from the completion of the sealing under normal use and indoor condition.

In another aspect of the invention, the Wc value of the wooden substrate prepared by methods of the present invention increases by less than 10 over a 180 day period starting from the completion of sealing under normal use and indoor condition.

In still another aspect of the invention, the Wc value of the wooden substrate prepared by methods of the present invention remains below 12 over a 180 day period starting from the completion of sealing, wherein the Wc value immediately after sealing is below 7, under normal use and indoor condition.

It should be understood that the Wc value of the wooden substrate sealed with methods of the present invention may suddenly increase by more than 10 or increase to above 12 if the wooden substrate was placed in extreme temperature or humidity. For example, the Wc value may shortly increase from 5 to 18 when the wooden substrate was exposed in a snowing or tropical environment. This short spike of Wc, however, does not affect the enhanced visual aspect stability that the present invention provides as the Wc value will steadily decrease once the wooden substrate was placed back in a normal, indoor condition. The Wc value usually returns to what it was before the wooden substrate was placed in extreme temperature or humidity in two weeks. This short spike of Wc value and its subsequent recovery was simulated in Examples below by "shocking" the wooden substrate. Thus, it is within the scope of the present invention if the Wc value of the wooden substrate prepared by methods of the present invention increases by more than 10, or to above 12, within the 180 day period starting from the completion of the sealing due to extreme temperature or humidity. Extreme temperature and humidity mean those conditions generally found uncomfortable by people, usually below 10° C. or above 28° C. and relative humidity below 25% or above 55%.

EXAMPLES

The present invention is explained in detail in the following Examples, which do not limit the present invention. In the Examples, coating compositions were prepared according to manufacturers' protocol, which is described below and publicly available.

Material

Degreaser was selected from commercially available isopropyl alcohol, methyl ethyl ketone, acetone, or Duro-Lak DS-22 produced by Duro Lak, Inc., at 1065 Stacey Crt. Mississauga, Ontario Canada. Flame retardant Duro-Lak MP828 FR was available from Duro Lak, Inc. Topcoat was selected from ZMP-7773, which comprises promoter DUR3498A, catalyst DUR3499A, and reducer DS61, available from Duro Lak, Inc. Duro-Lak ZMP-3000, ZMP-3001, ZMP-3002, ZMP-3003, ZMP-3005, and ZMP-3009, which comprised promoter RW-204, catalyst CAT2015A, and reducer DS27, were available from Duro Lak, Inc. Polyutherane composition used to seal the control group were prepared by mixing ZMP-693A (resin) and ZMP-668B (hardener), both available from Duro Lak, Inc. Techno Lam 8481 and Techno Coat 8482 EXP were made by Polymeres Technologies at 2637, des Seigneurs Est., Saint-Hyacinthe, Quebec J2R1Y3, Canada. Curing accelerator Accelerateur 8482 is produced by Polymeres Technologies. Polishing is performed by using 3M Perfect III Polishing System or 3M Polish-Extra Fine produced by 3M company. Finish reviver Quick Gloss 40129 from US Chemicals and Plastics may also be used. Sanding was performed by using carborundum abrasives Stick-On™ orbital sanding disks or carborundum abrasives Stick-On™ Sheet Rolls from Saint-Gobain Abrasives Canada, Inc., at 3 Beach Road, P.O. Box 3008, Hamilton, Ontario L8L7Y5, Canada. Sanding was also performed using 3M Orbital Sanding discs from 3M Company or its commercial equivalent. Dimensional stability was measured by Micro Wavescan manufactured by BYK-Gardner USA, at 9104 Guilford Road, Columbia, Md. 21046, USA.

Step 1

Foundation Sanding

Wood veneer and hardwood were first sanded with 180-220 grit sandpaper using an orbital air sander or a sanding block to remove all scratches and imperfections. The sanding created a smooth surface. A sanding machine such as Timesavers™ 3300 series may be used to facilitate sanding. Drum and feeder speeds will vary according to the wood or wood veneer's hardness.

Step 2

Optional Fire Treatment

Veneer or solid wood that has not been treated by wood suppliers may require fire treatment. The surface of the wooden substrate was cleaned with a soft cloth and degreaser selected from commercially available isopropyl alcohol, methyl ethyl ketone, or Duro-Lak DS-22. The cleaning was immediately followed by wiping the surface with a dry cloth to remove remaining solvent residue, such as dust or oil.

One uniform cross-coat, which is one spray vertically and one spray horizontally, of flame retardant Duro-Lak MP 828 of less than 4 mils of wet thickness was sprayed onto the surface of the wooden substrate per manufacturer's instructions. The sprayed wooden substrate was allowed to dry for 20 minutes at room temperature. Another uniform cross-coat of fire retardant Duro-Lak MP828 of less than 4 mils of wet thickness may be applied.

Step 3

Staining

The wooden surface was stained with a soft bristle brush, spray, rag or sponge cloth application to achieve the color depth and intensity needed for the wooden substrate. Alcohol quality non-grain-rising (NGR) stain was applied to the surface of the wooden substrate, and left air dried for 30 minutes at 120° F.

Step 4

Sealing with Techno Lam 8481/Techno Coat 8482 EXP

Complete evaporation of the wood degreaser was confirmed before applying sealing composition. Techno Lam 8481 and Techno Coat 8482 EXP were prepared by mixing the designed ratio of resin and hardener per manufacturer's instructions. Accelerateur 8482 may be added to accelerate the curing.

The wooden substrate was put in a spray booth of 22° C. and two uniform cross-coats of 3 to 4 mils of wet thickness of Techno Lam 8481 or Techno Coat 8482 EXP were sprayed onto the surface. The first coat was allowed to cure for at least 30 minutes before the second coat was applied. The sealing composition was allowed to dry for 16 hours at 22° C., and then heated at 50° C. at 20% humidity for 3 hours.

Step 5

Intermediary Smoothing

The coated substrate was allowed to cool down for at least 6 hours before it was manually sanded with 180 or 220 grit sandpaper. Holes, joints and open grain were filled in manually with the same topcoat composition. The surface was further cleaned with a degreaser selected from commercially available isopropyl alcohol, methyl ethyl ketone, or Duro-Lak DS-22 to remove any dirt, oil, or fingerprints.

Step 6

Top Coat

Polyester topcoat ZMP-7773 was prepared and applied to the wooden substrate per the manufacturer's instruction. Three cross-coats of 4 to 6 mils of wet thickness were uniformly sprayed onto the surface of the sealed substrate with 15 to 20 minutes of waiting between each coat. After waiting for 40 minutes after the third cross-coat, the coated article was heated for at least 2 hours at 120° F. Optionally a fourth cross-coat may be applied onto the wooden substrate.

Step 7

Optional Coating

Optionally more layers of topcoat composition may be applied and sanded to provide additional properties to the surface. Procedures described in Steps 5 and 6 were repeated with the same or different topcoat composition. The wooden substrate coated with the final coat was allowed to dry for at least 72 hours before polishing.

Step 8

Polishing

Polishing is the process of increasing gloss by sanding the coated substrate with increasingly higher grits. The coated article was manually sanded, in the following order, with 400 grit sandpaper, 600 grit sandpaper, 800 grit sandpaper, 1000 grit sand paper, and 1200 grit sandpaper, all on 3/32 orbital (12000 rpm) air sander or its equivalent. The sanding removes fine scratches and surface aberrations.

In the alternative, the coated wooden substrate was sanded with 3M Perfect-it III Finishing Kit, 3M Perfect-it III Polishing compound (-05936 Extra Cut Rubbing Compound), and 3M Perfect-it III Machine Glaze (-05937) according to 3M's protocol.

After the coated substrate was sanded, it was further polished with 3M Extra-Cut. Finally the coated substrate was polished with 3M Machine Glaze Finesse-it 06002 Polish-Extra Fine until the substrate exhibits sufficient gloss and no more visible hair lines.

Step 9

Satin Finish

A satin finish may be achieved after holes, joints, and open grains on the surface were filled in with the same topcoat compositions and dust or lint left on the surface was cleaned with a soft cloth and DS-22 cleaner.

If a matte or satin finish is preferred over a gloss finish, the coating procedure is identical to Step 6 except at least two cross-coats of 4 to 5 mils of wet thickness of Duro-Lak ZMP-3000, ZMP-3001, ZMP-3002, ZMP-3003, ZMP-3005, or ZMP-3009 were applied. The satin coat is the final coat. No waiting time is required between applying the two satin coat layers. After the final topcoat is applied the coated wooden substrate was left in the spray booth for at least 15 minutes at 95° F. No heating was required. The coated wooden substrate was ready for handling after it cooled down for 24 hours at 80° F.

Step 10

Touch Up

Touch up is the minor finishing to correct flaws that occur when working with natural substrates like hard woods and veneers. Manual observation of minor imperfections may require small rework such as additional staining, cleaning, or applying topcoat to defect areas.

Step 11

Testing Dimensional Stability

Wooden substrates of Pomele Sepele, Striped Sapele, Walnut, Waterfall Bubinga, and White Ash, were prepared according to methods of the invention and tested for their dimensional stability.

Wooden substrates in the control group were sealed with polyutherane compositions prepared by mixing Duro-Lak ZMP-693A (resin) and ZMP-666B (hardener) per the manufacturer's instructions. This topcoat composition is the conventional sealer used in manufacturing aircraft interiors. Wooden substrates in the testing group were sealed with sealing compositions comprising Techno Lam 8481 or Techno Coat 8482 EXP before the topcoat composition was applied. For both groups, sealing composition of 3 mils wet thickness were sprayed onto the wooden substrate and allowed to dry for 15-20 minutes before the topcoat composition was applied.

Duro-Lak ZMP-7773 was used as a polyester topcoat composition for wooden substrates in both the control and testing group. Duro-Lak ZMP-7773 of 12-15 mils wet thickness was applied onto the wooden substrates and allowed to dry at least overnight before the wavescan measurement was taken. Wooden substrates were "shocked," i.e. abruptly exposed to environment of 35° C. and 75% humidity, at various time points to accelerate the change of visual aspect stability.

On each wooden substrate, a square foot area was selected for wavescan measurement. Seven measurements were taken along the grain and seven taken against the grain, with each measurement point 1 inch apart. The final Wc value is the average of all 14 measurements for each wooden samples. Measurements were taken every one week, two weeks, or three weeks.

Tables 1 and 2 show the wavescan results of measurements for wooden substrates in the control group. As shown in all tables below, the Wc values fluctuated with the seasons because of the change of humidity levels. In Table 1, wooden substrates in the control group were shocked on day 309 and Wc values were measured starting from day 54. On day 180, or six months after the test began, the Wc values of all samples increased by at least 6.5 from their Wc values on day 54. For example, the Wc value of Pomele Sapele increased by 16.9 from day 54 to day 180, Striped Sapele increased by 11.97, Waterfall Bubinga increased by 15.17, and Walnut increased by 6.59 over the same period of time.

TABLE 1

Control: wooden Substrates Sealed With Polyutherane Composition

| Day | Pomele Sapele | Striped Sapele | Waterfall Bubinga | Walnut |
|---|---|---|---|---|
| 54 | 21.89 | 8.60 | 10.33 | 9.07 |
| 61 | 22.07 | 9.01 | 11.07 | 9.37 |
| 68 | 25.40 | 10.67 | 12.93 | 10.57 |
| 75 | 24.54 | 12.31 | 14.40 | 12.37 |
| 82 | 24.80 | 10.13 | 14.17 | 11.31 |
| 97 | 26.96 | 12.83 | 17.10 | 12.71 |
| 110 | 25.56 | 13.66 | 16.19 | 11.99 |
| 117 | 26.06 | 14.00 | 19.90 | 11.80 |
| 138 | 30.54 | 16.24 | 19.83 | 13.30 |
| 145 | 33.50 | 17.73 | 22.24 | 14.90 |
| 152 | 33.56 | 18.79 | 23.29 | 14.14 |
| 180 | 38.79 | 20.57 | 25.50 | 15.66 |
| 187 | 40.40 | 21.53 | 25.64 | 15.21 |
| 259 | 38.10 | 17.49 | 23.00 | 14.30 |
| 309 | 43.8 | 20.3 | 16.8 | 18.6 |
| 351 | 55.4 | 22.0 | 21.2 | 20.7 |
| 420 | 34.9 | 25.6 | 31.3 | 26.3 |

In Table 2, all wooden substrates started from a low Wc value around 3. The Wc values sharply increased immediately after the wooden substrates were shocked on days 37 and 142, but slowly recovered thereafter. The Wc value of Pomele Sapele, Striped Sapele, and Water Bubinga remained above 12 until at least day 512, whereas the Wc value of Walnut exceeded 12 starting from day 142. On day 180, 6 months after the test began, the Wc value of all wooden substrates increased by at least 10.9 compared to the Wc value on day 0. The Wc value of Pomele Sapele increased by 10.9, Striped Sapele 18.7, Waterfall Bubinga 25.1, and Walnut 12.2 over the same period of time.

TABLE 2

Control: wooden Substrates Sealed With Polyutherane Composition

| Days | Pomele Sapele | Striped Sapele | Waterfall Bubinga | Walnut |
|---|---|---|---|---|
| 0 | 3.6 | 3.1 | 3.9 | 3.1 |
| 1 | 3.6 | 2.9 | 4.1 | 3.1 |
| 7 | 3.9 | 3.7 | 4.7 | 3.3 |
| 15 | 5 | 5.2 | 7.1 | 3.9 |
| 28 | 6 | 6 | 7.4 | 4 |
| 34 | 4.9 | 6.1 | 7.5 | 4 |
| 37 | 24.8 | 40.9 | 42.4 | 24.9 |
| 47 | 16.3 | 28.4 | 26.1 | 14.7 |
| 55 | 12.8 | 21.4 | 23.1 | 11.3 |
| 79 | 12.2 | 17.3 | 19.5 | 10.6 |
| 92 | 12.1 | 17.9 | 21.6 | 10.5 |
| 124 | 12.4 | 16.3 | 23.7 | 11.5 |
| 135 | 12.6 | 17.4 | 21.4 | 11.7 |
| 142 | 18.3 | 28.8 | 29.3 | 17.8 |
| 152 | 16.1 | 26.7 | 25.1 | 14.6 |

TABLE 2-continued

Control: wooden Substrates Sealed With Polyutherane Composition

| Days | Pomele Sapele | Striped Sapele | Waterfall Bubinga | Walnut |
|---|---|---|---|---|
| 180 | 14.5 | 24.9 | 29 | 15.3 |
| 196 | 16.6 | 29.2 | 29.4 | 15.8 |
| 212 | 17.8 | 30.2 | 32.1 | 16.6 |
| 232 | 18.8 | 31.2 | 31.5 | 18.3 |
| 247 | 19.7 | 33 | 34.4 | 20.1 |
| 287 | 20.5 | 34 | 33.8 | 20 |
| 323 | 19.6 | 31.1 | 34.1 | 19.2 |
| 352 | 20.3 | 31.2 | 40 | 20.7 |
| 398 | 18.6 | 28.4 | 31.6 | 17.4 |
| 412 | 18.3 | 25.7 | 35.3 | 18.8 |
| 428 | 17 | 27.3 | 33.4 | 18.6 |
| 447 | 16.4 | 26.5 | 35 | 18.2 |
| 460 | 17.4 | 24.3 | 34.3 | 17.4 |
| 512 | 16 | 25.2 | 31.3 | 17 |

Table 3 shows the results for wooden substrates sealed with sealing composition comprised of Techno Coat 8482 EXP before the topcoat composition is applied. The sealed wooden substrate exhibited great suppression of substrate distortion. Specifically, Pomele Sapele, Striped Sapele and Waterfall Bubinga maintained Wc value below 12 until at least day 504 even when they were shocked twice on days 15 and 38. On day 179, or about six months after the test began, the Wc values of all samples increased by at most 6.45 compared to the Wc values on day 0 or day 8. For example, Pomele Sapele increased by 5.45, Striped Sapele increased by 6.45, and Waterfall Bubinga increased by 6.35.

TABLE 3

Invention: wooden Substrate Sealed With Sealing Composition Comprising Techno Coat 8482 EXP

| Days | Pomele Sapele | Striped Sapele | Waterfall Bubinga |
|---|---|---|---|
| 0 | — | — | 2.5 |
| 8 | 1.5 | 1.85 | 2.7 |
| 15 | 3.2 | 3.7 | 5 |
| 18 | 2.85 | 3.25 | 3.9 |
| 36 | 1.9 | 3.05 | 2.9 |
| 38 | 3.6 | 3.75 | 5.4 |
| 45 | 1.8 | 3.55 | 3.35 |
| 51 | 2.15 | 4.1 | 3.7 |
| 59 | 2.6 | 4.75 | 4.05 |
| 72 | 3.15 | 5 | 5.2 |
| 78 | 3.75 | 5.65 | 5.4 |
| 81 | 3.4 | 4.85 | 5.05 |
| 91 | 4.5 | 6.9 | 5.9 |
| 98 | — | — | — |
| 99 | 4.9 | 6.35 | 6.75 |
| 123 | 6.85 | 7.2 | 8.3 |
| 138 | 7.3 | 7.6 | 8.95 |
| 168 | 7.25 | 8.7 | 9.75 |
| 179 | 6.95 | 8.3 | 8.85 |
| 196 | 6 | 7.5 | 7.95 |
| 224 | 4.4 | 6.3 | 5.7 |
| 240 | 2.75 | 4.45 | 4.9 |
| 256 | 2.25 | 3.85 | 4.2 |
| 276 | 2.35 | 3.65 | 4.7 |
| 291 | 2.9 | 3.75 | 4.25 |
| 331 | 2.65 | 4 | 4 |
| 456 | 4.7 | 9.05 | 9 |
| 472 | 6.8 | 8.55 | 8.7 |
| 491 | 7.55 | 9.05 | 9.45 |
| 504 | 7.7 | 10.1 | 9.75 |

Table 4 shows the results of wooden substrate sealed with sealing composition comprised of Techno Lam 8481. The wooden substrates were shocked on day 71. The Wc peaked immediately after the shocking but quickly recovered to below 10. The Wc values of all wooden substrates remained below 12 until at least day 337. On day 181, the Wc value of all wooden substrates increased by at most 5.3 compared to day 15. Striped Sapele increased by 3.7, Waterfall Bubinga 2.8, Walnut 5.3, and Ebony increased by 1.5 on day 195.

TABLE 4

Wooden Substrates Sealed With Sealing Composition Comprised of Techno Lam 8481

| Days | Striped Sapele | Waterfall Bubinga | Walnut | Ebony |
|---|---|---|---|---|
| 15 | 3.3 | 5.7 | 1.3 | 6.3 |
| 30 | 3.4 | 6.4 | 1.4 | 6.2 |
| 70 | 4.2 | 6.6 | 2.0 | 6.5 |
| 71 | 24.7 | 17.0 | 7.4 | 12.5 |
| 75 | 8.8 | 7.8 | 4.1 | 9.5 |
| 82 | 8.9 | 9.5 | 3.3 | 7.7 |
| 106 | 6.9 | 8.1 | 2.5 | 7.1 |
| 135 | 7 | 7.3 | 2.7 | 6.9 |
| 181 | 7 | 8.5 | 6.6 | 4.1 |
| 195 | 9 | 8.6 | 5.5 | 7.8 |
| 211 | 9.4 | 7.3 | 4.3 | 7.8 |
| 230 | 8.4 | 8.7 | 6.8 | 7.5 |
| 243 | 7.7 | 8.2 | 6.8 | 8.0 |
| 295 | 7.9 | 10.7 | 7.0 | 8.5 |
| 337 | 7.9 | 9.2 | 5.6 | 9.8 |

The testing results show that methods of the present invention effectively enhanced visual aspect stability. Throughout the testing period, wooden substrates sealed by methods of the present invention show a slower increase of Wc value compared to those sealed with polyurethane composition.

Wooden substrates sealed by methods of the present invention were also able to maintain a Wc value below 12, the minimum standard for wooden surfaces in the aviation industry, for at least 337 days starting from the completion of the sealing. The Wc values of wooden substrates sealed by methods of the present invention rarely exceeded 10 for as long as 504 days, whereas the Wc values of wooden substrates sealed with conventional methods increased to above 15 as soon as day 196.

In normal conditions, without shocking, the wooden substrate sealed with methods of the present invention is expected to exhibit visual aspect stability for an even longer time.

While the invention has been illustrated in detail in the foregoing description, the same is to be considered as illustrative and not restrictive in nature. It is understood that only the preferred embodiment has been shown and described fully and that all changes and modifications that come within the spirit of invention are desired to be protected.

The invention claimed is:

1. A method for sealing a wooden substrate comprising the steps of:

a. preparing a sealing composition by mixing a thermosetting resin with a hardener; the thermosetting resin comprising, in percentage of weight, more than 50% Bisphenol A Epoxy Resin, between 0.1% and 50% Tricresyl Phosphate, and between 0.1% and 30% Glycidyl Ether; the hardener comprising, in percentage of weight, between 40% and 90% isophoronediamine, and between 5% and 50% 1,3-benzenedimethanamine;

b. applying onto at least one surface of the wooden substrate at least one layer of sealing composition; and c. curing the sealing composition to form a sealed wooden substrate.

2. The method of claim 1, wherein the thermosetting resin comprises, in percentage of weight, more than 60% Bisphenol A Epoxy Resin.

3. The method of claim 1, wherein the thermosetting resin comprises, in percentage of weight, more than 70% Bisphenol A Epoxy Resin.

4. The method of claim 1, wherein the sealing composition comprises, in percentage of weight, between 10% and 40% Tricresyl Phosphate.

5. The method of claim 1, wherein the sealing composition comprises, in percentage of weight, between 20% and 30% Tricresyl Phosphate.

6. The method of claim 1, wherein the sealing composition comprises, in percentage of weight, between 0.1% and 20% Glycidyl Ether.

7. The method of claim 1, wherein the sealing composition comprises, in percentage of weight, between 0.1% and 10% Glycidyl Ether.

8. The method of claim 1, wherein the hardener comprises, in percentage of weight, between 50 and 80% isophoronediamine.

9. The method of claim 1, wherein the hardener comprises, in percentage of weight, between 60% and 70% isophoronediamine.

10. The method of claim 1, wherein the hardener comprises, in percentage of weight, between 10% and 40% 1,3-benzenedimethanamine.

11. The method of claim 1, wherein the hardener comprises, in percentage of weight, between 20% and 30% 1,3-benzenedimethanamine.

12. The method of claim 1, wherein the sealing composition comprises a high temperature resin epoxy formed by the polymerization of an epoxide resin and a polyamine hardener.

13. The method of claim 1, wherein the sealing composition comprises a fire retardant and a high temperature resin epoxy formed by the polymerization of an epoxide resin and a polyamine hardener.

14. The method of claim 1, wherein the wooden substrate is treated with flame retardant before the sealing composition is applied.

15. The method of claim 1, wherein the wooden substrate is coated with a polymer composition selected from the group consisting of epoxy, urethane, polyurethane, acrylic, methyl methacrylate, a polyester, or mixtures thereof, before the sealing composition is applied.

16. The method of claim 1, wherein the wooden substrate is coated with a water based polymer composition before the sealing composition is applied.

17. The method of claim 1, wherein the sealing composition includes one or more agents selected from the group consisting of antistatic agents, biostabilizers, bittering agents, chemical blowing agents, conductivity agents, corrosion inhibitors, drying agents, flame retardants, fluorescent whitening agents, hollow and/or solid glass spheres, lubricants, pigments, plasticizers, scent additives, UV stabilizers, viscosity adjustment fillers, and fungicides.

18. The method of claim 1, wherein the sealing composition to form a layer of between 1 to 10 mils of wet thickness is applied onto the wooden substrate.

19. The method of claim 1, wherein the sealing composition to form a layer of between 4 to 8 mils of wet thickness is applied onto the wooden substrate.

20. The method of claim 1, wherein the sealing composition is cured by drying at 22° C. for at least 7 days.

21. The method of claim 1, wherein the sealing composition is cured by drying at 22° C. for at least 16 hours, then heated at 40 to 50° C. for at least 16 hours.

22. The method of claim 1, wherein the sealing composition is cured at 22° C. for at least 16 hours, then heated at 50° C. to 60° C. for at least 3 hours.

23. The method of claim 1, wherein the sealing composition comprises a curing accelerator.

24. The method of claim 23, wherein the curing accelerator comprises triethanolamine and N-aminoethylpiperazine.

25. The method of claim 1, wherein the sealing composition comprises layers of different polymer compositions.

26. The method of claim 1, wherein the sealing composition is smoothened after the sealing composition is substantially cured.

27. The method of claim 1, wherein the method comprises the additional steps of:

a. sanding the surface of the sealed wooden substrate;

b. applying onto the sealed surface of the wooden substrate at least one layer of topcoat composition; and c. curing the topcoat composition to form a coated wooden substrate.

28. The method of claim 27, wherein the topcoat composition comprises a polymer composition selected from the group consisting of: ethylene-vinyl acetate, polypropylene, ethylene-methyl acrylate and ethylene-methyl methacrylate/polyethylene copolymers, polyethylene, polyethylene acid terpolymers, polyethylene isonomers, polyamide co- and ter-polymers, thermoplastic elastomers, acrylonitrile-butadiene-styrene, acrylonitrile halogenated polyethylene, acrylonitrile halogenated styrene, acrylic-styrene acryonitrile, cellulose acetate, cellulose acetate-butyrate, cellulose acetate-propionate, halogenated polyethylene, halogenated polyvinyl chloride, polymonochlorotrifluoroethylene, diallyl phthalate, ethyl cellulose, ethylene-chlorotrifluoroethylene, ethylene-propylene, tetrafluoroethlyene hexafluoropropylene-vinylidene fluoride ter-polymer, ethylene vinyl alcohol, polyether block amide, ethylene tetraflurethylene, fluorinated ethylene-propylene, high-impact polystyrene, vinyl modified epoxy, liquid crystal polymer, methacrylateo-butadiene-styrene, polyamide, polyamide-imide, polyacrylonitrile, polybutylene, polybutylene terephthalate, polycarbonate, polychlorotrifluoroethylene, polyphenylene ether copolymer, polyetherether ketone, polyphenylene ether homopolymer, polyetherimide, polyethylene oxide, polyethersulphone, phenyl-formaldeahycle, perfluoroalkoxy, polyimide, polyisobutylene, polyisoethylene, paramethylstyrene, polymethylpentene, polyphenylene oxide, polyphenylene sulfide, polystyrene, polytetrafluoroethylene, polyurethane (polyester and polyether backbone), polyvinyl chloride, polyvinylidene fluoride, polyvinyl fluoride, styrene acrylonitrile, styrene maleic anhydride, polytetra fluorethylene, urea-formaldehyde, vinyl acetate-ethylene, polyacetal, polyacrylic, polyalkyd, polyallylic esters or allyis, cellulosic esters, halogenated polyalkylene ether, cyanate/cyanamide polymers, halogenated epoxies, cycloaliphatic epoxies, epoxyimide polymers, polyester polymers, polyether polymers, and polyphenylene, and mixtures thereof.

29. The method of claim 27, wherein the topcoat composition comprises layers of different polymer compositions.

30. The method of claim 27, wherein the topcoat composition comprises a polyester.

31. The method of claim 30, wherein at least three cross-coats of 4 to 6 mils of wet thickness of topcoat compositions are applied onto the coated surface of the wooden substrate.

32. The method of claim 27, wherein the topcoat composition exhibits a matte or satin finish.

33. The method of claim 32, wherein the topcoat composition comprises a polyester forming a matte finish.

34. The method of claim 1, wherein the sealed wooden substrate has a Wc value which increases less than the increase of the We value of wooden substrate sealed with polyurethane composition for at least 180 days starting from the completion of sealing under normal use and indoor condition.

35. The method of claim 1, wherein the sealed wooden substrate has a Wc value that increases by less than 10 over a 180 day period starting from the completion of sealing under normal use and indoor condition.

36. The method of claim 1, wherein the sealed wooden substrate has a Wc value of below 12 over a 180 day period starting from the completion of sealing, wherein the Wc value immediately after sealing is below 7, under normal use and indoor condition.

37. The method of claim 1, wherein the sealed wooden substrate exhibits enhanced visual aspect stability in comparison to an unsealed wooden substrate.

* * * * *